United States Patent [19]

Martelli

[11] Patent Number: 4,516,945

[45] Date of Patent: May 14, 1985

[54] METHOD TO EVENLY HEAT AN ASYMMETRIC GETTER DEVICE BY INDUCTION

[75] Inventor: Daniele Martelli, Milan, Italy

[73] Assignee: S.A.E.S. Getters S.p.A., Milan, Italy

[21] Appl. No.: 488,698

[22] Filed: Apr. 26, 1983

[30] Foreign Application Priority Data

Apr. 28, 1982 [IT] Italy ..... 20971 A/82

[51] Int. Cl.[3] ..... H01J 9/395

[52] U.S. Cl. ..... 445/19; 219/10.79

[58] Field of Search ..... 445/9, 19; 313/560; 219/10.79

[56] References Cited

U.S. PATENT DOCUMENTS

| | | | |
|---|---|---|---|
| 2,451,297 | 10/1948 | Moore | 445/19 X |
| 2,553,925 | 5/1951 | Lucas | 219/10.79 X |
| 4,260,930 | 4/1981 | Hens et al. | 313/560 X |

*Primary Examiner*—Kenneth J. Ramsey

*Attorney, Agent, or Firm*—Quaintance & Murphy

[57] ABSTRACT

An induction coil and a process for evenly heating an asymmetric getter device. The induction coil has a major coil and a smaller minor coil. A portion of the major coil is substantially coincidental with a portion of the minor coil. A different portion of the major coil is offset with respect to the minor coil.

8 Claims, 5 Drawing Figures

METHOD TO EVENLY HEAT AN ASYMMETRIC GETTER DEVICE BY INDUCTION

The use of getter devices in kinescopes is well known. It is also well known to use internal coatings of high electrical resistance in order to reduce the danger of short circuits and electric arcs or discharges between various closely spaced electrodes of the electron gun as well as between the electrodes and other parts of the kinescope.

However, kinescopes employed as color television picture tubes make use of high voltages. Because of these high voltages, extraneous particles that accidentally find their way to the vicinity of the electron gun may distrub its insulating properties and facilitate the above-mentioned electric arcs and electric discharges. To further reduce dangers of electric arcs and discharges, it is desirable that getter metal liberated from the getter device be prevented from depositing undesirable quantities of getter metal on the internal walls of the kinescope in the vicinity of the neck of the kinescope.

In order to solve the above problems and inconveniences, a special getter device has been produced. This getter device is described in U.S. Pat. No. 4,260,930 and shows a semicircular upstanding shield or high wall separately attached to the outer wall of the ring getter container. The upstanding shield or high wall can, if desired, be formed integrally in one piece with the outer wall of the ring getter container. These getter devices have an external wall with a high portion and a low portion. The high portion serves to deflect atoms of getter metal away from the neck portion of the kinescope and, therefore, away from the gun of the kinescope. However, the asymmetric design of these getter devices create special problems when they are heated by means of induction currents generated by a traditional induction coil. One problem is that getter metal tends to condense on the upper portion of the outside wall. This getter metal has a danger of subsequently falling off and causing the above-described short circuits.

Accordingly, it is an object of the present invention to provide a means for solving one or more of the above problems.

Another object of the present invention is to provide a process for heating an asymmetric getter device while avoiding deposition of getter metal on the upraised wall portion.

Yet another object of the present invention is to provide an improved induction coil for evenly heating an asymmetric getter device.

The above and other objects of the present invention are accomplished by providing an induction coil for evenly heating an asymmetric getter device by electrical induction heating. The induction coil comprises a major coil and a smaller, minor coil. A portion of the major coil is substantially coincidental with a portion of the minor coil. A portion of the major coil is offset with respect to the minor coil.

The invention may be better understood by reference to the following description and drawings wherein.

Figure 3:
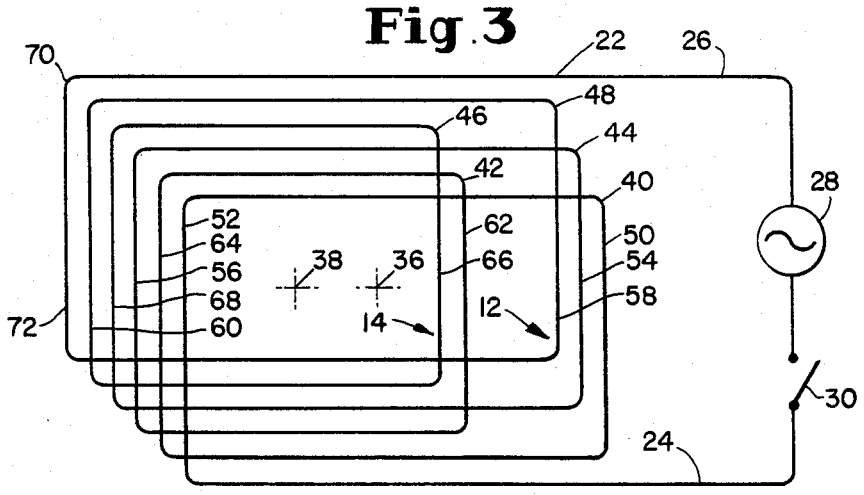
Figure 4:
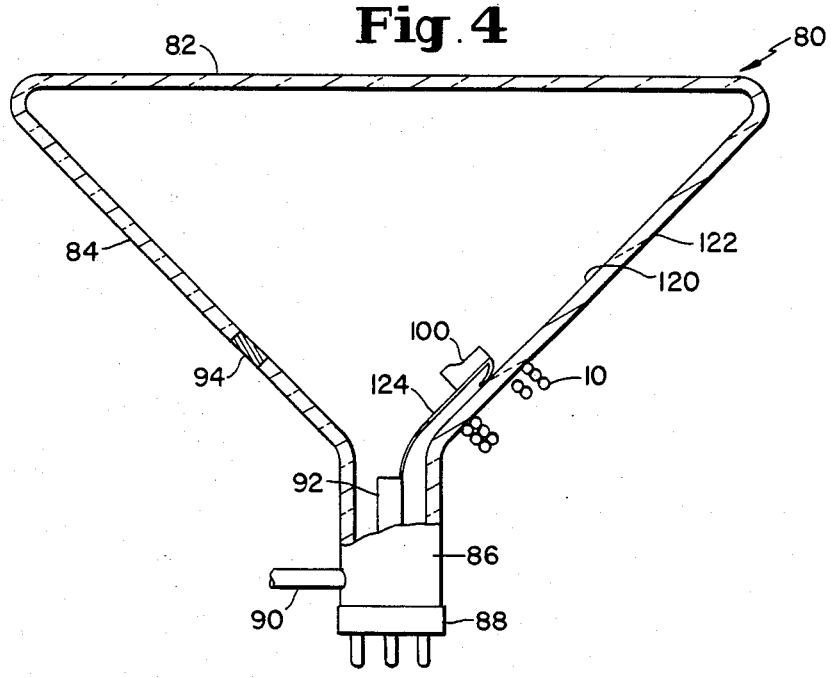
Figure 5:
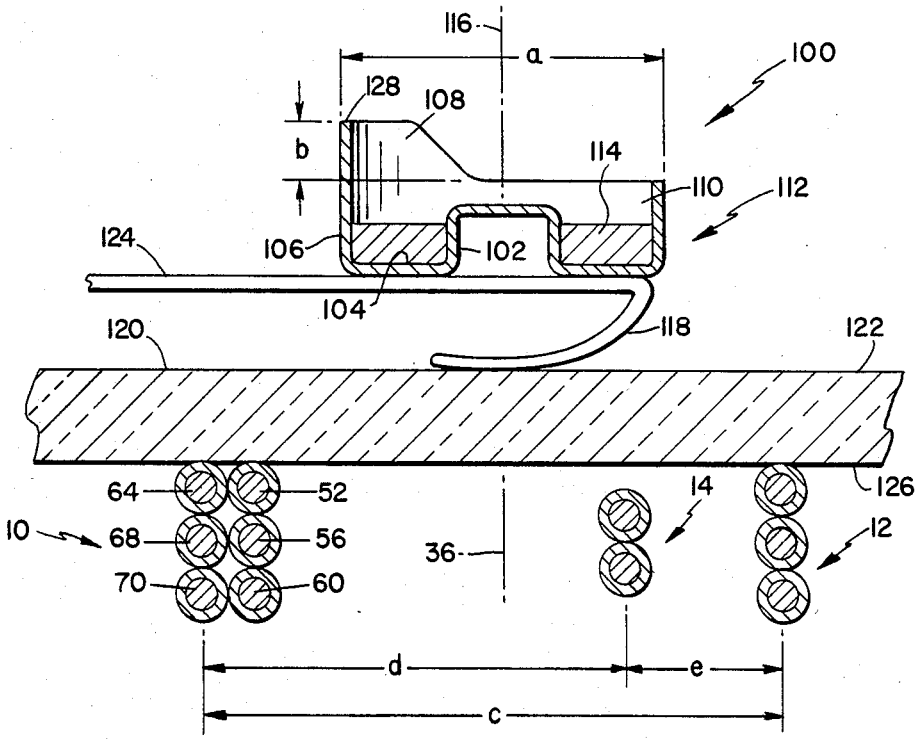

FIG. 3 is a schematic representation of the induction coil of the present invention showing the loops which form the major coil and the minor coil; and FIG. 4 is a schematic sectional view of a kinescope showing the induction coil of the present invention in a position adapted to evenly heat an asymmetric getter device pursuant to the process of the present invention; and FIG. 5 is an enlarged sectional view of that portion of FIG. 4 showing the induction coil and the getter device.

Figure 1:
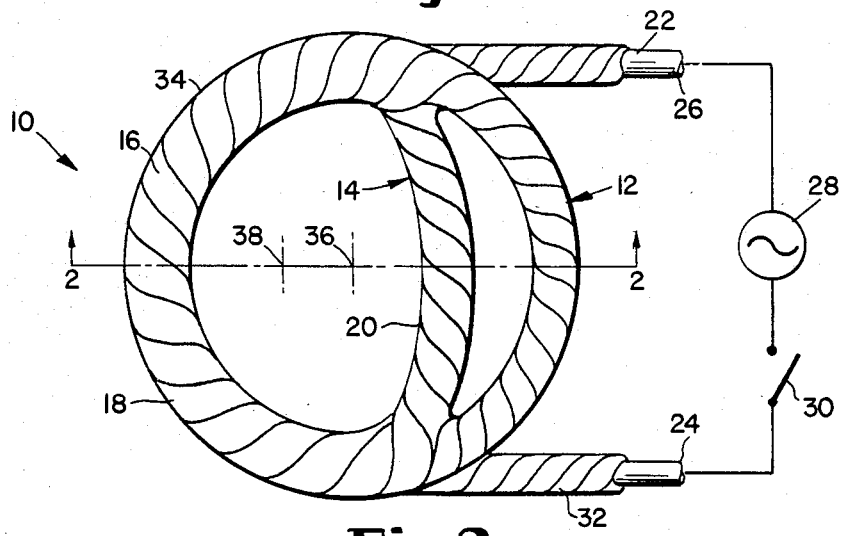
FIG. 1 is a plan view of an induction coil of the present invention.
Figure 2:
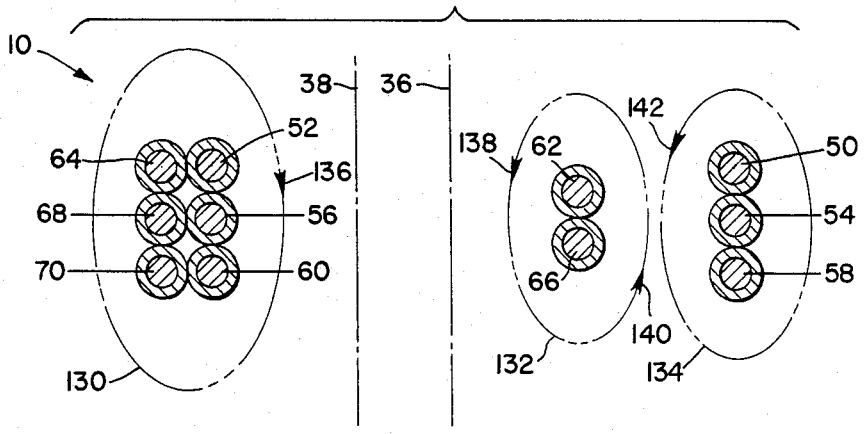
FIG. 2 is a sectional view taken along Line 2—2 of FIG. 1.

Referring now to the drawings in general and to FIGS. 1 and 2 in particular, there is shown an induction coil 10 of the present invention. The induction coil 10 comprises a major coil 12 and a smaller minor coil 14. A portion 16 of the major coil 12 is substantially coincidental with a portion 18 of the minor coil 14. On the other hand, the other portion 20 of the minor coil is offset with respect to the major coil 12.

The induction coil 10 is formed from a single conductor 22 having ends 24,26. The ends 24,26 are connected in series with a high frequency generator 28 and a switch 30. The conductor 22 is provided with insulation 32 throughout its entire length. Furthermore, the entire induction coil 10 is advantageously provided with a covering 34 of additional insulation material. In FIG. 2, the covering 34 has been omitted for clarity.

In the embodiment shown in FIG. 1, the major coil 12 is circular about an axis 36 whereas the minor coil 14 is generally eliptical about an axis 38.

Referring now to FIG. 3, the formation of the conductor 22 into the major coil 12 and the minor coil 14 can be seen. Starting with the end 24, the conductor 22 forms the first loop 40 of the major coil 12; then the first loop 42 of the minor coil; then the second loop 44 of the major coil 12; then the second loop 46 of the minor coil 14; then the third loop 48 of the major coil 12, after which the conductor 22 terminates in the end 26. It can thus be seen that the major coil 12 consists of the loops 40, 44, and 48, whereas the minor coil 14 consists of the loops 42, 46. As is clearly shown in FIGS. 2 and 3, the loops 40, 44, 48 of the major coil 12 are substantially coincidental throughout their entire length. Similarly, the loops 42, 46 of the minor coil 14 are substantially coincidental throughout their entire length.

Referring still to FIG. 3, it can be seen that the first loop 40 of the major coil 12 has a right side 50 and a left side 52. The second loop 44 of the major coil 12 has a right side 54 and a left side 56. Similarly, the third loop 48 of the major coil 12 has a right side 58 and a left side 60.

Referring still to FIG. 3, it can be seen that the first loop 42 of the minor coil 14 has a right side 62 and a left side 64. The second loop 46 of the minor coil 14 has a right side 66 and a left side 68. The major coil 12 also has an additional one-half loop 70 which has only a left side 72 and has no corresponding right side. Thus it can be seen that the left side of the minor coil 14 represented by the left side 64 and the left side 68 is substantially coincidental with the left side of the major coil 12, which left side of the major coil 12 is represented by the left sides 52, 56, and 60 of the major coil 12. On the other hand, the right side of the minor coil 14 represented by the right side 62 and right side 66, respectively, of the loops 42 and 46 is spaced inwardly from the other side of the major coil 12 represented by the sides 50, 54, 58, respectively, of the loops 40, 44, 48 of the major coil 12. Furthermore, it can be seen that the major coil 12 has three and one-half loops represented by the loops 40, 44, 48 and the half-loop 70, whereas the minor coil 14 has two loops represented by the loops 42, 46.

Referring now to FIGS. 4 and 5, there is shown a kinescope 80 having a viewing screen 82 connected to a cone 84 which, in turn, is connected to a neck 86. The neck 86 is provided with a closure 88 such that the kinescope 80 can be evacuated through the connection 90 by conventional means. The kinescope 80 is fitted with an electron gun 92 and an anode button 94. The kinescope 80 is also provided with a getter device 100. The getter device 100 comprises a cylindrical inner wall 102 connected to a bottom wall 104 which, in turn, is connected to an outside wall 106. The outside wall 106 has a high portion 108 and a low portion 110. The inner wall 102, the bottom 104, and the outside wall 106 together comprise the container 112 of the getter device 100. Within the container 112 is a getter-metal releasing material 114. The getter-metal releasing material 114 releases the getter metal when heated. The container 112 is symmetrical about its axis 116 with the exception of the high portion 108. The container 112 is equipped with a sled 118 which rests on the inside surface 120 of the wall 122 of the cone 84 of the kinescope 80. The getter device 100 is also equipped with a spring 124 which is attached to the gun 92 by which contact is maintained between the sled 118 and the inside surface 120 of the wall 122.

In operation, the getter device 100 is placed within the kinescope 80 on the inside surface 120 of the wall 122. The kinescope 80 is then evacuated through the connection 90 in a completely conventional manner whereupon the connection 90 is closed by the industry standard process known as "tip-off". The induction coil 10 is then placed on the outside surface 126 of the wall 122 of the kinescope 80 with the axis 36 of the major coil 12 substantially coincidental with the axis 116 of the getter device 100. Furthermore, the high portion 108 of the outside wall 106 of the getter device 100 is adjacent to that portion of the major coil 12 which is coincidental with the minor coil 14, which is represented by the left sides 52, 56, 60, 64, 68, 70. The switch 30 (see FIG. 1) is then closed, causing an alternating radio frequency current to pass through the induction coil 10 which heats the getter device 100 and thereby evaporates the getter metal from the getter-metal releasing material 114. Because of the structure of the coil 10, the getter device 100 is evenly heated. No getter metal is deposited on the high portion 108.

The getter metal released from the getter-metal releasing material 114 can be any evaporable getter metal but is preferably barium.

The major coil 12 can have one loop or more than one loop, but preferably has from two to ten loops and ideally has three and one-half loops. The minor coil 14 can have one loop or more than one loop, but generally has from one to ten loops and ideally has two loops.

The major coil 13 can have a wide variety of shapes and can be eliptical, square or circular. It is preferably circular to make it especially useful with circular getter devices. The minor coil can likewise have a wide variety of shapes and can be square, circular or eliptical, but is preferably eliptical because of ease with which the left side of the minor coil can be made coincidental with the left side of the major coil 12 while maintaining spacing between the right side of the major coil 12 and the right side of the minor coil 14. In a preferred embodiment, the axis 38 of the minor coil 14 is offset with respect to the axis 36 of the major coil 12, but the axes 36,38 are preferably parallel.

The conductor 22 can have any cross-sectional shape, but is preferably round and is preferably a hollow tube. The conductor 22 is shown as solid in the drawings for convenience only.

The getter device 100 can be in the antenna position as shown in FIG. 4 or can be attached to the anode button 94 or can be positioned elsewhere within the kinescope 80.

The material of the container 112 can be any material which is heated when subjected to a high frequency alternating current such as iron, nickel, and alloys thereof such as stainless steel. Any high frequency current can be employed by the high frequency generator 28 which will heat the getter container 112 to a temperature at which evaporation of the getter metal begins but is generally between 100 and 1000 kHz and is preferably 200 to 500 kHz.

The invention may be better understood by referring to the following practical example. In this example, the getter device 100 had an outside diameter "a" as shown in FIG. 5 of 20 mm. The height "b" of the high portion 108 above the low portion 110 was 6 mm. The induction coil 10 had an outside diameter "c" of 60 mm and had the structure shown in FIGS. 1, 2 and 3. The conductor 22 was in the form of a copper tube having an outside diameter of about 8 mm. The minor coil 14 had an outside diameter "d" of about 23 mm. The distance "e" between the major coil 12 and the minor coil 14 was about 12 mm. The inductance of the coil 10 was 1.57 $\mu$H. The current passed through the coil 10 had a frequency of 400 kHz and 0.6 amps. The getter material 114 was a standard exothermic getter material. The test was conducted with the getter device 100 resting on a wall 122 have a thickness equal to the standard thickness of the wall of the cone 84 of the kinescope 80. Visual examination of several getter devices 100 so treated under vacuum showed that even on the uppermost edge 128 of the high portion 108 that there was no evidence of deposition of getter material.

The scientific theory underlying this invention is not completely understood. However, referring to FIG. 2, it might be assumed that the induction coil 10 produces a flux field represented by lines of force 130, 132, 134 in a direction represented by arrowheads 136, 138, 140, and 142. Since arrowheads 136 and 138 are in the same direction, they enhance the force field, whereas since arrowheads 140 and 142 are in opposite directions, they decrease the force field. On the other hand, the force field may be distorted to give a flux component which induces circulating currents only in the high portion 108 while leaving a circular component in the low portion 110.

Although the invention has been described in considerable detail with reference to various preferred embodiments thereof, it will be understood that various modifications can be made by those skilled-in-the-art without departing from the spirit of the invention and while remaining within the scope of the appended claims.

What is claimed is:

1. A method for evaporating a getter metal from a getter device within a kinescope which getter device comprises a container holding the getter-metal releasing material, wherein the container has an outside wall having a high portion and a low portion, wherein the container has a central axis; said method comprising the steps of:

I. placing the getter device within the kinescope on the inside surface of the wall of the kinescope; and then II. placing an induction coil comprising a major coil having an axis and a smaller minor coil wherein a portion of the major coil is substantially coincidental with a portion of the minor coil, and wherein a portion of the major coil is offset with respect to the minor coil; on the outside surface of the wall of the kinescope with the axis of the major coil substantially coincidental with the axis of the getter device and with the high portion of the outside wall of the getter device adjacent to that portion of the major coil which is coincidental with the minor coil; and then III. passing an alternating radio-frequency current through the induction coil to heat the getter device and thereby evaporate the getter metal.

2. The method of claim 1 wherein the getter device is mounted in the kinescope in the antenna position.

3. The method of claim 1 wherein the getter device is mounted in the kinescope attached to the anode button.

4. The method of claim 1 wherein the getter metal in the getter device is barium.

5. The method of claim 1 wherein the container for the getter metal is constructed of a material that exhibits hysteresis losses.

6. The method of claim 1 wherein the high portion of the wall is between the axis of the getter device and the gun of the kinescope.

7. The method of claim 1 wherein the current has a frequency of 100 to 1000 kHz.

8. The method for evaporating barium from a getter device within a kinescope having a gun which getter device comprises a container holding the getter-metal releasing material, wherein the container has an outside wall having a high portion and a low portion, wherein the container has a central axis; said method comprising the steps of:

I. placing the getter device within the kinescope in the antenna position on the inside surface of the wall of the kinescope; and then II. evacuating the kinescope; and then III. placing an induction coil wherein:

(a) said coil comprises a continuous electrical conductor, the ends of which are adapted to be electrically connected to a source of high-frequency alternating current; and (b) the conductor has a plurality of substantially coincidental circular major loops which form a circular major coil about an axis and a plurality of substantially coincidental eliptical minor loops which form a minor coil; and (c) the major coil has a diameter larger than that of the minor coil; and (d) one side of the minor coil is substantially coincidental with one side of the major coil; and (e) the other side of the minor coil is spaced inwardly from the other side of the major coil on the outside surface of the wall of the kinescope with the axis of the major coil substantially coincidental with the axis of the getter device and with the high portion of the outside wall of the getter device adjacent to that portion of the major coil which is coincidental with the minor coil; wherein the high portion of the wall of the getter device is between the axis of the getter device and the gun of the kinescope; and then IV. passing a current through the induction coil at a frequency of 200 to 500 kHz to evenly heat the getter device and evaporate the barium without deposition of barium on the high portion of the getter device.

* * * * *